US006303258B1

(12) United States Patent
Katoh et al.

(10) Patent No.: US 6,303,258 B1
(45) **Date of Patent: *Oct. 16, 2001**

(54) ELECTROPHOTOGRAPHIC TONER AND IMAGE FORMING METHOD USING THE TONER

(75) Inventors: Kohki Katoh, Shizuoka-ken; Satoshi Mochizuki; Yasuo Asahina, both of Numazu; Tomomi Suzuki, Gotenba, all of (JP)

(73) Assignee: Ricoh Company, Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/493,186

(22) Filed: Jan. 28, 2000

(30) Foreign Application Priority Data

Jan. 29, 1999 (JP) ..... 11-022959

(51) Int. Cl.[7] ..... G03G 9/00; G03G 13/14

(52) U.S. Cl. ..... 430/110.1; 430/110.4; 430/126

(58) Field of Search ..... 430/110, 126, 430/110.1, 110.4

(56) References Cited

U.S. PATENT DOCUMENTS

| | | | | |
|---|---|---|---|---|
| 4,051,077 | * | 9/1977 | Fisher | 430/110 |
| 4,681,830 | * | 7/1987 | Holland et al. | 430/110 |
| 4,762,763 | | 8/1988 | Nomura et al. | 430/110 |
| 4,933,250 | | 6/1990 | Nakayama et al. | 430/106 |
| 4,980,258 | | 12/1990 | Aoki et al. | 430/110 |
| 5,034,298 | * | 7/1991 | Berkes et al. | 430/110 |
| 5,061,588 | | 10/1991 | Fushima et al. | 430/109 |
| 5,344,732 | | 9/1994 | Chiba et al. | 430/42 |
| 5,403,690 | | 4/1995 | Kuramoto et al. | 430/110 |
| 5,484,675 | * | 1/1996 | Tripp et al. | 430/110 |
| 5,554,478 | | 9/1996 | Kuramoto et al. | 430/109 |
| 5,612,159 | * | 3/1997 | Sato et al. | 430/110 |
| 5,776,646 | * | 7/1998 | Hagi et al. | 430/110 |
| 5,827,632 | * | 10/1998 | Inaba et al. | 430/110 |
| 5,840,456 | | 11/1998 | Tomita et al. | 430/106 |

FOREIGN PATENT DOCUMENTS 08-314231 11/1996 (JP) .

* cited by examiner

*Primary Examiner*—Mark Chapman
(74) *Attorney, Agent, or Firm*—Oblon, Spivak, McClelland, Maier & Neustadt, P.C.

(57) ABSTRACT

An electrophotographic toner, which is useful in an image forming method in which a toner image, which is formed on a latent image bearing member, is transferred onto an intermediate transfer member and then the transferred toner image is transferred onto a receiving material, including toner particles including a binder resin and a colorant, and a particulate fluorine-containing material.

21 Claims, 1 Drawing Sheet

ELECTROPHOTOGRAPHIC TONER AND IMAGE FORMING METHOD USING THE TONER

BACKGROUND OF THE INVENTION

1. Field of the Invention

Figure 1:
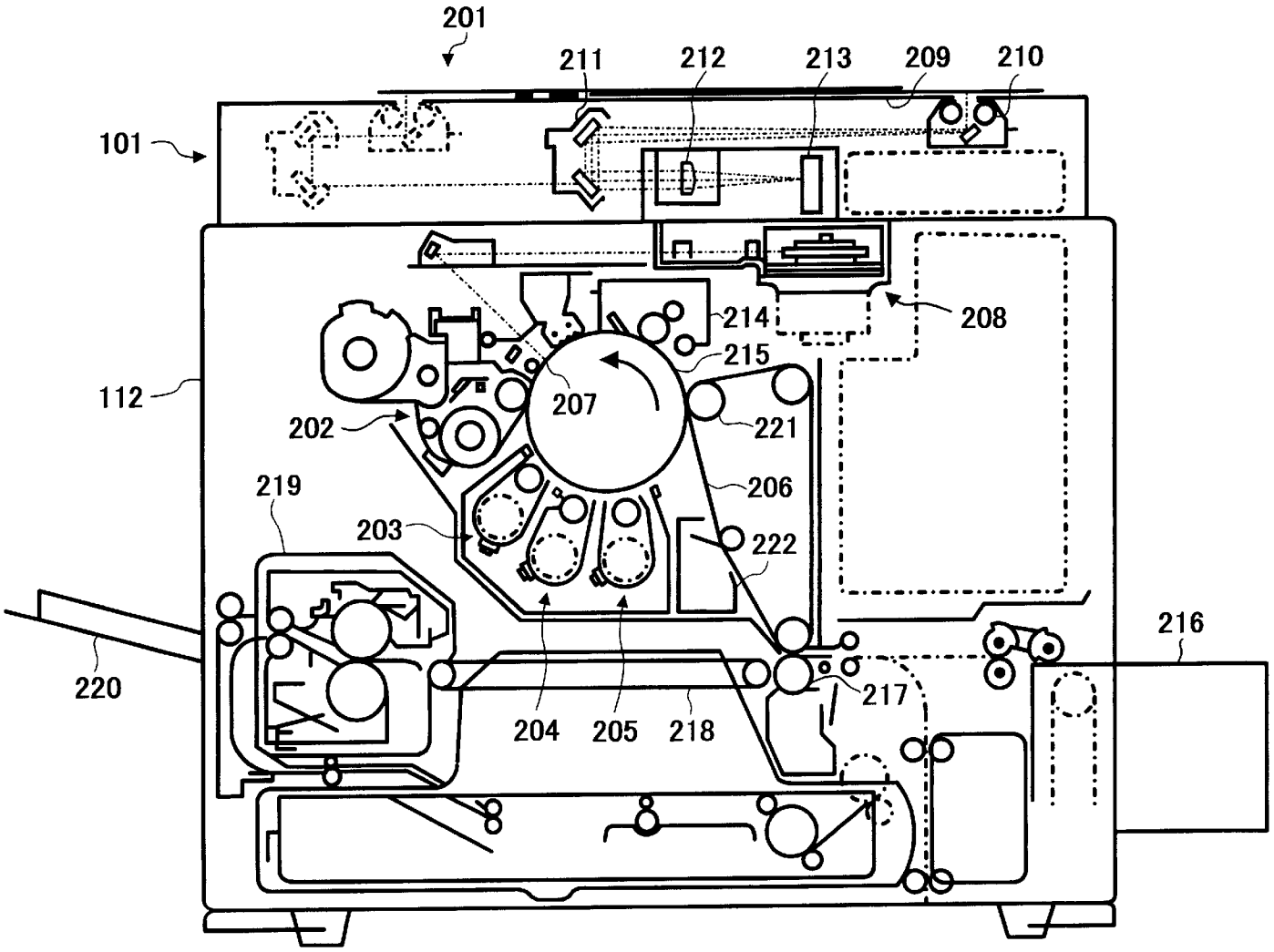

The present invention relates to a toner useful for electrophotography, and to an image forming method using the toner. More particularly, the present invention relates to a toner useful for an electrophotographic image forming method in which toner images are transferred from an image bearing member to a receiving material via an intermediate transfer member.

2. Discussion of the Background

Image forming apparatus such as copiers, printers and facsimile machines using the following electrophotographic image forming method are well known:

(1) an electrostatic latent image is formed on an image bearing member such as a photoconductor;

(2) the latent image is developed with a toner to form a toner image on the image bearing member;

(3) the toner image is transferred to an intermediate transfer member;

(4) the toner image transferred on the intermediate transfer member is then re-transferred on a receiving material such as a paper sheet; and (5) the toner image on the receiving material is fixed, for example, upon application of heat, to form a fixed toner image.

This image forming method is particularly useful for forming a color image. For example, a yellow (Y) toner image, a magenta (M) toner image, a cyan (C) toner image and a black (Bk) toner image, which are formed on a respective image bearing member, are transferred on an intermediate transfer member one by one to form a color toner image thereon. The color toner image is transferred on a receiving material at a time and then fixed. Thus, a color image can be prepared.

The advantages of image forming apparatus using such an intermediate transfer member over image forming apparatus in which toner images formed on an image bearing member are directly transferred on a receiving material are as follows:

(1) position differences between color images transferred on a receiving material can be improved;

(2) even when various receiving materials having different characteristics are used, toner images are clearly transferred on the receiving materials.

Therefore, the image forming apparatus having an intermediate transfer member are preferably used as color image forming apparatus.

In general, a cleaning mechanism, such as a blade cleaning device, a fur blush cleaning device, a web cleaning device, or a magnetic blush cleaning device, is generally provided in such image forming apparatus having an intermediate transfer member to remove the toner, which remains on the intermediate transfer member without being transferred. However, these cleaning devices cannot perfectly remove the remaining toner, and the toner still remaining on the intermediate transfer member gradually accumulates thereon, resulting in formation of a toner film on the intermediate transfer member. When the toner film is formed on the intermediate transfermember, the transfer ability of the intermediate transfer member gradually deteriorates. Therefore uneven toner transferring occurs or a white spot problem in that white spots are formed in the transferred toner images tends to occur, resulting in deterioration of the image qualities of the resultant toner images (this problem is hereinafter referred to as a toner filming problem).

In image forming apparatus using a belt-shaped intermediate transfer member, both of first image transferring in which toner images are transferred from an image bearing member to the belt-shaped intermediate transfer member, and second image transferring in which the toner images are transferred from the transfer belt to a receiving material are performed using a roller. Namely, the toner images on the image bearing member are transferred on the transfer belt while the belt is pressed by a roller toward the image bearing member. Similarly, the toner images on the transfer belt is transferred on a receiving material while the belt is pressed by a roller toward the receiving material. By using a roller in toner transferring, adhesion of toner particles to the image bearing member, the intermediate transfer member and the receiving material is increased. In addition, adhesion between the toner particles is also increased, resulting in formation of toner aggregates. When toner aggregates are formed, a high pressure is locally applied to the aggregates by a roller, resulting in formation of omission in toner images as if the toner images are eaten by worms (hereinafter these images are referred to be worm-eaten images). In particular, the worm-eaten images are observed in line images.

In order to avoid the toner filming problem and the worm-eaten images, the following measures are taken:

(1) one or more fatty acid metal salts such as zinc stearate, and fluorine compounds are included in a top layer of the intermediate transfer member; and (2) a coating mechanism is provided for coating one or more fatty acid metal salts, such as zinc stearate, and fluorine compounds, on the intermediate transfer member.

However, even when these measures are taken for an intermediate transfer member, uneven transferring or white spots are generated if the intermediate transfer member is used for a long time. Therefore the intermediate transfer member has a short life. In addition, when a coating mechanism is provided in an image forming apparatus, the image forming apparatus becomes complex and large-sized, resulting in increase of manufacturing costs.

Techniques are also well known in which a fatty acid metal salt such as zinc stearate, or a particulate acrylic polymer is included in a toner in order to impart good cleaning properties to a toner. However, such a toner is used for an image forming apparatus having an intermediate transfer member, the following problems tend to occur:

(1) a filming problem in which a film of the fatty acid metal salt or the acrylic polymer is formed on the intermediate transfer member; and (2) a problem in which the fatty acid metal salt or the acrylic polymer in the toner accumulates in various parts of the developing unit of the image forming apparatus when the toner is used for a long time, resulting in deterioration of fluidity and charging properties of the toner, and thereby image qualities deteriorate.

Japanese Laid-Open Patent Publication No. 8-314231 discloses an image forming method in which an intermediate transfer member is used without cleaning. Namely, the toner remaining on the intermediate transfer member is removed by a transfer roller and the like to which a voltage having a polarity opposite to that of the toner is applied to catch the remaining toner. However, the toner cannot be sufficiently removed from the intermediate transfer member by such a method. In addition, this method has a drawback in that a new cleaner must be provided in the image forming apparatus to remove the toner adhered on the transfer roller.

Because of these reasons, a need exists for an image forming method and apparatus using an intermediate transfer member which can produce images having good image qualities for a long time.

SUMMARY OF THE INVENTION

Accordingly, an object of the present invention is to provide an electrophotographic toner which is used for an image forming method and apparatus using an intermediate transfer member and which can stably produce images having good image qualities for a long time.

Another object of the present invention is to provide an image forming method which uses an intermediate transfer member and which can stably produce images having good image qualities for a long time.

Briefly these objects and other objects of the present invention as hereinafter will become more readily apparent can be attained by a toner in which a particulate fluorine-containing material is added to toner particles including a binder resin and a colorant.

Specific examples of the fluorine-containing material includes particulate fluorine-containing organic resin materials, particulate fluorine-containing inorganic materials and the like.

The fluorine-containing material is preferably included in the toner particles in an amount ranging from 0.01 to 1.1 parts by weight per 100 parts by weight of the toner particles.

The volume average particle diameter of the fluorine-containing material is preferably from 0.05 to 1.0 $\mu$m.

In another aspect of the present invention, an image forming method is provided in which a toner image formed on an image bearing member is transferred onto an intermediate transfer member and then onto a receiving material, wherein the toner image is formed by the toner mentioned above.

These and other objects, features and advantages of the present invention will become apparent upon consideration of the following description of the preferred embodiments of the present invention taken in conjunction with the accompanying drawing.

BRIEF DESCRIPTION OF THE DRAWING(S)

Various other objects, features and attendant advantages of the present invention will be more fully appreciated as the same becomes better understood from the detailed description when considered in connection with the accompanying drawing in which like reference characters designate like corresponding parts throughout and wherein:

FIG. 1 is a schematic view illustrating the cross section of an image forming apparatus useful for the image forming method of the present invention.

DETAILED DESCRIPTION OF THE INVENTION

Generally, the present invention provides an electrophotographic toner useful in an image forming method in which a toner image, which is formed on an image bearing member according to a latent image thereon, is transferred to an intermediate transfer member and then the transferred toner is transferred to a receiving material, wherein the toner includes toner particles (hereinafter sometimes referred to as a mother toner) including a binder resin and a colorant, and wherein the toner further includes a particulate fluorine-containing material.

The toner of the present invention hardly generates a toner filming problem in that a toner film is formed on the intermediate transfer member because the particulate fluorine-containing material is included in the toner. In addition, the toner of the present invention has good transferability, resulting in formation of images having good image qualities without generating omissions in the resultant toner images even when used for a long time.

In the present invention, the particulate fluorine-containing materials mean particulate materials including one or more fluorine elements therein, and known fluorine-containing materials can be used.

Suitable particulate fluorine-containing materials include particulate fluorine-containing resins, particulate fluorine-containing inorganic materials and the like.

Fluorine-containing resins include:

(1) polymers made by polymerizing a fluorine-containing monomer;

(2) copolymers made by copolymerizing two or more fluorine-containing monomers; and (3) copolymers made by copolymerizing one or more fluorine-containing monomers and one or more other monomers.

Specific examples of the fluorine-containing monomers include vinyl fluoride, vinylidene fluoride, trifluoroethylene, tetrafluoroethylene, 1-chloro-1,2-difluoroethylene, 1,2-dichloro-1,2-difluoroethylene, bromotrifluoroethylene, 3,3,3-trifluoropropene, 3-chloro-3,3-difluoro-1-propene, 3-fluoro-3,3-dichloro-1-propene, 1-chloro-1-fluoroethylene, 1,1-difluoro-2-chloroethylene, 1,1-dichloro-2-fluoroethylene, 1-chloro-2,2-difluoroethylene, 1,1-dichloro-2,2-difluoroethylene, chlorotrifluoroethylene, 1-bromo-1-fluoroethylene, 1-chloro-2-fluoroethylene, (meth)acrylic acid which is substituted with fluorine and their derivatives, and the like.

In the present invention, polymers or copolymers, which are made bypolymerizing a monomer or monomers including at least one monomer selected from the group consisting of tetrafluoroethylene, vinylidene fluoride, chlorotrifluoroethylene, and hexafluoroisopropyl methacrylate are preferably used as the fluorine-containing resins. Among these polymers and copolymers, polytetrafluoroethylene is more preferable.

The surface of the particulate fluorine-containing resins may be treated with a surfactant, an charge controlling agent and/or the like.

Suitable particulate fluorine-containing inorganic materials include particulate materials which can be made of, for example, an ore (bastnaesite) of cerium oxide, which includes fluorine. In detailed description, bastnaesite is pulverized, treated by a wet process and then filtered to prepare a cake. The cake is calcined, powdered and classified to form a particulate fluorine-containing inorganic material. In this case, fluorine element is included in the particulate fluorine-containing inorganic material as a form of R—O—F, wherein R represents a rare earth element, O represents an oxygen atom and F represents a fluorine atom.

In addition, the particulate fluorine-containing inorganic materials can be prepared by treating the fluorine-containing inorganic materials mentioned above with a fluorine-containing treating agent or by treating inorganic materials which do not include fluorine and which are made of an ore having no R-O-F bond. Specific examples of the fluorine-containing treating agents include fluoroalkyl silane such as trifluoropropyltrimethoxy silane, trifluoropropyltrichloro silane, tridecafluorooctyltrimethoxy silane, heptadecafluorodecyltrichloro silane, heptadecafluorodecyltrimethoxy silane, heptadecafluorodecylmethyldimethoxy silane and heptadecafluorodecylmethyldichloro silane; fluorine-modified silicone oils; and the like.

The content of fluorine in the particulate fluorine-containing inorganic materials is preferably from 0.1 to 10.0% by weight, and more preferably from 0.5 to 5% by weight. The content of fluorine can be determined by a known method such as an alkali fusion method, an ion meter method and the like.

When the fluorine content is less than about 0.1% by weight, the toner remaining on the intermediate transfer member and the latent image bearing member tends not to be sufficiently removed, resulting in deterioration of transferability of toner images. When the fluorine content is greater than about 10% by weight, a toner having good fluidity and charge properties is not necessarily obtained.

The particulate fluorine-containing material added in a toner is present on or near the surface of the toner. When such a toner is used for the image forming apparatus using an intermediate transfer member, the contact area between the toner and the intermediate transfer member or the latent image bearing member decreases, resulting in prevention of occurrence of the toner filming problem on the intermediate transfer member or the latent image bearing member. In addition, by using the particulate fluorine-containing material in a toner, the cleaning ability of the toner can be enhanced. Therefore, good images can be produced even when the toner is used for a long time.

In the present invention, the particulate fluorine-containing material is preferably included in the toner in an amount ranging from 0.01 to 1.1 parts by weight, and more preferably from 0.1 to 0.8% by weight, per 100 parts by weight of a mother toner. When the content of the particulate fluorine-containing material is less than 0.01% by weight, the effects mentioned above tend to be hardly exerted. In contrast, when the content is greater than 1.1% by weight, a toner having good fluidity and charge properties is not necessarily obtained. In addition, the developing properties of the toner tends to deteriorate.

In addition, the particulate fluorine-containing materials preferably have a volume average particle diameter ranging from 0.05 to 1.0 $\mu$m, and more preferably from 0.1 to 0.5 $\mu$m. When the volume average particle diameter is greater than 1.0 $\mu$m, the intermediate transfer member and the latent image bearing member tend to be hurt. In addition, a toner having good fluidity and good charge properties cannot be obtained, and therefore problems such as toner scattering and background fouling tend to occur, resulting in deterioration of image qualities. In contrast, when the volume average particle diameter is less than 0.05 $\mu$m, there is sometimes a case that the filming problem cannot be prevented.

When the volume average particle diameter of the toner is from 0.05 to 1.0 $\mu$m, the distance between the mother toner of the toner and the intermediate transfer member or the latent image bearing member can be maintained so as to be proper, and therefore the electrostatic adhesion of the toner to the intermediate transfer member or the latent image bearing member can be maintained so as to be proper, resulting in prevention of occurrence of the toner filming on the intermediate transfer member or the latent image bearing member, and improvement of the transferability of the toner images.

The particulate fluorine-containing materials preferably have a spherical shape. By using spherical fluorine-containing particles in a toner, the contact area between the toner and the intermediate transfer member or the latent image bearing member decreases, the transferability of the toner images can be further improved.

The particulate fluorine-containing resins can be prepared by any one of known polymerization methods. In order to prepare spherical fluorine-containing resins, emulsion polymerization methods, soap-free emulsion polymerization methods, suspension polymerization methods and the like can be preferably used. Alternatively, spherical fluorine-containing resins can be prepared by the following processes:

(1) performing polymerization by any one of these methods mentioned above, solution polymerization methods, bulk polymerization methods and the like, to prepare a polymer;

(2) dissolving the polymer in a solvent; and (3) granulating the polymer using a spray drying method.

Among these methods, soap-free emulsion methods are especially preferable because the methods can easily control the particle diameter and the shape of the polymers.

The particulate fluorine-containing materials preferable have a spherical degree not less than 0.95 and more preferably not less than 0.97. The spherical degree is defined as follows:

$$\text{Spherical degree}=L_0/L$$

wherein Lo represents the circumference of a circle having the same area as that of the photographed image of a toner particle, and L represents the length of outer surface of the photographed image of the toner particle.

The spherical degree quantitatively represents the sphericalness of a particle, and the nearer to 1 the spherical degree of a particle, the closer to a circle the shape of the particle.

The measuring method of the spherical degree of particles is as follows:

(1) taking a photograph of particles after magnifying the particles from 5000 to 20000 times using a transmission electron microscope, H-800 manufactured by Hitachi Ltd.;

(2) randomly picking 300 or more particle images having a diameter not less than 0.01 $\mu$m; and (3) analyzing the particle images by an image analyzing apparatus, Luzex 3 manufactured by Nireco Corp.

It is preferable that the toner of the present invention further includes a particulate inorganic material in addition to the particulate fluorine-containing material.

Suitable particulate inorganic materials include oxides or complex oxides of Si, Ti, Al, Mg, Ca, Sr, Ba, In, Ga, Ni, Mn, W, Fe, Co, Zn, Cr, Mo, Cu, Ag, V, Zr and the like, but are not limited thereto. Among these materials, silica, titania and alumina are preferably used. The content of the particulate inorganic material in the toner is preferably from 0.3 to 1.6% by weight, and more preferably from 0.5 to 1.2% by weight, per 100 parts by weight of the mother toner. When such an inorganic material is added to the mother toner in the amount not less than 0.3% by weight, the resultant toner becomes to have good fluidity.

When the particulate inorganic material is added to the mother toner in an amount of greater than 1.6% by weight, the toner filming problem tends to occur even when the particulate fluorine-containing material is added to the mother toner.

In addition, the surface of the particulate inorganic material for use in the present invention is preferably treated with an agent to improve the hydrophobic properties, fluidity, charge properties, etc., of the inorganic material.

Suitable materials for use as the surface treating agent include organic silane compounds. Specific examples of the silane compounds include alkylchloro silanes such as methyltrichloro silane, octyltrichloro silane, and dimethyldichloro silane; alkylmethoxy silanes such as dimethyldimethoxy silane, and octyltrimethoxy silane; hexamethyl disilazane, silicone oils and the like.

The particulate inorganic materials can be treated by any one of the following methods:

(1) a method in which a particulate inorganic material is dipped in a solution including an organic silane compound and then dried;

(2) a method in which an organic silane compound solution is sprayed to a particulate inorganic material; and the like method.

Both the methods can be preferably used.

In the present invention, a silica and a titania, whose surfaces are treated, are preferably used as the particulate inorganic material. At this point, the addition content of the titania is preferably greater than that of the silica. The weight ratio of the silica to the titania is preferably from 1:1 to 1:5, and more preferably from 1:1.2 to 1:2.5.

When the silica is added in an amount of greater than the titania, the charge of the resultant toner excessively increases because silica itself has large charge imparting properties. In addition, when the particle diameter of the toner decreases, surface areas of the toner per a unit weight of the toner increase, and the charge of the resultant toner, which is caused by friction, excessively increases. When a surface-treated titania is added to a mother toner in an amount of greater than a surface-treated silica, a toner having a proper charge can be obtained. In addition, a toner having charge properties, which hardly change even when environmental conditions are changed, can be obtained.

The average primary particle diameter of the particulate inorganic materials for use in the present invention is preferably from 0.002 to 0. 1 $\mu$m, and more preferably from 0.005 to 0.05 $\mu$m, to impart good fluidity to the resultant toner.

When the average primary particle diameter is less than 0.002 $\mu$m, the particulate inorganic material tends to be buried in the toner, and therefore problems, in which the resultant toner aggregates and in which a toner having good fluidity cannot be obtained, tend to occur. These problems prominently occur in color toners which have a property of sharply-melting. In addition, when the average primary particle diameter is less than 0.002 $\mu$m, the particulate inorganic material aggregates itself and therefore the resultant toner has poor fluidity.

When the average primary particle diameter is greater than 0.1 $\mu$m, the fluidity of the resultant toner decreases, resulting in deterioration of the charge properties, and thereby problems such as background fouling and toner scattering tend to occur. In addition, particulate inorganic materials having an average primary particle diameter of greater than 0.1 $\mu$m tend to hurt the intermediate transfer member and the latent image bearing member and to cause the toner filming problem.

The particle diameter of the particulate inorganic materials can be measured by a transmission electron microscope.

The weight average particle diameter of the toner of the present invention is preferably from 4 to 9 $\mu$m. When the weight average particle diameter is less than 4 $\mu$m, background fouling tends to occur in the resultant toner images, and fluidity of the resultant toner deteriorates, resulting in deterioration of supplying properties and cleaning properties of the resultant toner. When the weight average particle diameter is greater than 9 $\mu$m, resolution of the tone images deteriorates, which is a serious problem to color toner images.

The toner of the present invention preferably has a ratio of number average particle diameter (Dn) to weight average particle diameter (Dw), Dw/Dn, ranging from 1.0 to 1.5. When the ratio is greater than 1.5, the particle diameter distribution becomes broad and therefore the charge quantity distribution of the resultant toner also becomes broad, resulting in deterioration of stability in developing properties and transferring properties of the resultant toner. In addition, color tones of the resultant color toner images tend to vary.

The particle diameter of a toner can be measured by various methods. In the present invention, it is measured using Coulter Multisizer type IIe, manufactured by Beckman-Coulter Co. An interface and a personal computer are connected with the apparatus to obtain a number distribution and a volume distribution of diameter of a particulate material.

In the present invention, the method for measuring the particle diameter of a toner is as follows:

(1) preparing 1% aqueous solution of NaCl (first class), which serves as an electrolyte;

(2) adding 0.1 to 5 ml of a surfactant such as an alkylbenzene sulfonic acid salt, which serves as a dispersant, in the NaCl aqueous solution of from 100 to 200 ml;

(3) adding a sample to be measured in the NaCl aqueous solution such that the weight thereof is from about 2 to about 20 mg;

(4) dispersing the mixture by a supersonic dispersing device for about 1 to 3 minutes to prepare a dispersion;

(5) preparing another 1% aqueous solution of NaCl;

(6) adding the dispersion into the another NaCl aqueous solution such that the solid content of the dispersion is a predetermined solid content;

(7) measuring the particle diameter of the sample by Coulter Multisizer using an aperture of 100 $\mu$m.

The average particle diameter is obtained by averaging the diameters of 50,000 particles.

Suitable binder resins for use in the toner of the present invention include known resins for use in conventional toners. Specific examples of the resins include polystyrene resins, styrene-butadiene copolymers, styrene-vinyl chloride copolymers, styrene-acrylate copolymers, styrene-methacrylate copolymers, acrylic resins, polyester resins, epoxy resins, rosin-modified maleic acid resins, phenolic resins, low-molecular-weight polyethylene resins, low-molecular-weight polypropylene resins, ionomer resins, polyurethane resins, ketone resins, ethylene-ethyl acrylate copolymers, polyvinyl butyral resins, silicone resins and the like. Among these resins, styrene-acrylate copolymers, styrene-methacrylate copolymers, polyester resins, and epoxy resins are preferable. These resins can be used alone or in combination.

Specific examples of the colorant for use in the toner of the present invention include carbon black, lamp black, iron black, ultramarine, Nigrosine dyes, Aniline Blue, Phthalocyanine Blue, Phthalocyanine Green, Hansa Yellow G, Rhodamine 6G, Lake, Calco oil blue, Chrome Yellow, Quinacridone, Benzidine Yellow, Rose Bengale, triaryl methane dyes, monoazo dyes and pigments, disazo dyes and pigments and the like. These dyes and pigments are used alone or in combination.

The content of the colorant in the toner is generally from 1 to 30 parts by weight, and preferably from 3 to 20 parts by weight, per 100 parts by weight of the binder resin included in the toner.

Additives such as a charge controlling agent, a releasing agent and the like can be included in the toner of the present invention.

Suitable chare controlling agents for use in the toner of the present invention include Nigrosine dyes, complexes including chromium, quaternary ammonium salts, etc. One or more of these materials are used such that the resultant toner has the desired polarity. In particular, charge controlling agents, which are colorless or pale colored, are preferably used for color toners because they hardly affect color tones of the resultant color toners. For example, salicylic acid metal salts and metal salts of salicylic acid derivatives, such as Bontron E84 manufactured by Orient Chemical Co. Ltd., are preferably used. The content of the charge controlling agent in the toner is preferably from 0.5 to 8 parts by weight, and more preferably from 1 to 5 parts by weight, per 100 parts by weight of the binder resin included in the toner.

The releasing agent such as waxes is included in the toner of the present invention to impart good releasing ability to the toner. The toner having good releasing ability can be easily released from a fixing member such as a fixing roller when images of the toner are fixed, and the resultant fixed toner images have good fixing properties.

Specific examples of the waxes include paraffin waxes and their derivatives, montan waxes and their derivatives, microcrystalline waxes and their derivatives, Fisher-Tropsch waxes and their derivatives, polyolefin waxes and their derivatives, carnauba wax and its derivatives, and the like. As for the derivatives mentioned above, oxides, block copolymers or graft copolymers with one or more vinyl monomers, and the like are exemplified. In addition, alcohols, fatty acids, acid amides, esters, ketones, hardened caster oil and its derivatives, vegetable waxes, animal waxes, mineral waxes, petrolatum and the like can also be used as the releasing agent. The content of the releasing agent is generally from 1 to 20 parts by weight, and preferably from 2 to 10 parts by weight, per 100 parts by weight of the binder resin included in the toner.

The toner of the present invention may include a magnetic material to be used as a magnetic toner. Specific examples of the magnetic material for use in the toner include iron oxides such as magnetite, hematite, and ferrites; metal alloys of cobalt or nickel with one or more of other metals such as aluminum, copper, lead, magnesium, tin, zinc, antimony, beryllium, bismuth, cadmium, calcium, manganese, selenium, titan, tungsten, vanadium and the like.

The average particle diameter of the magnetic material for use in the present invention is from 0.1 to 2 $\mu$m, and the content thereof in the toner is preferably from 20 to 200 parts by weight, and more preferably from 40 to 150 parts by weight, per 100 parts by weight of the binder resin included in the toner.

The toner of the present invention may include other additives, for example, a lubricant such as zinc stearate, an abrasive such as silicon carbide, a caking inhibitor, and an electroconductive agent such as tin oxide.

The toner of the present invention may be used as a one-component or two-component developer. When the toner is used as a two-component developer, the toner is used together with a carrier. Specific examples of the carrier for use in the two-component developer of the present invention include known materials for use in the conventional two-component developers such as powders having magnetism, e.g., iron powders, ferrite powders, nickel powders, glass beads and the like.

Coated carriers in which one of these carrier materials mentioned above is coated with a resin are preferably used in the present. Specific examples of such a resin include carbon polyfluoride, polyvinyl chloride, polyvinylidene chloride, acrylic resins, silicone resins, and the like. The resin layer is formed by any one of conventional coating methods such as spray coating methods, dipping coating methods and the like.

The particle diameter of the carrier for use in the present invention is generally from 10 to 100 $\mu$m, and preferably from 30 to 60 $\mu$m. The amount of the resin used for coating the carrier is 1 to 10 parts by weight per 100 parts by weight of the carrier material.

In the present invention, the toner and the carrier are preferably mixed in a ratio of the toner to the carrier of from 0.5:100 to 7.0:100 by weight.

The toner of the present invention is generally manufactured by the following method:

(1) a binder resin, and a pigment or a dye serving as the colorant are mixed by a mixer such as a Henshel mixer, if desired, together with additives such as a charge controlling agent, a releasing agent, and other additives;

(2) the mixture is kneaded by one of heat kneaders, for example, batch type kneaders such as two-roll mills and Banburry's mixer; and continuous kneaders such as two-axle extruders, e.g., KTK type two-axle extruder manufactured by Kobe Steel, Ltd., TEM type two-axle extruder manufactured by Toshiba Machine Co., Ltd., PCM type two-axle extruder manufactured by Ikegai Corp., KEX type two-axle extruder manufactured by Kurimoto, Ltd., and continuous one-axle kneaders such as KO-KNEADER manufactured by Buss AG.;

(3) the kneaded mixture is cooled, crushed by a hammer mill and the like, pulverized by a pulverizer using jet air or a mechanical pulverizer, and then classified by a classifier using rotating air or Coanda effect to obtain a mother toner having a desired particle size.

The toner of the present invention can also be manufactured by a polymerization method, a capsule method and the like.

The polymerization method is as follows:

(1) one or more polymerizable monomers are dispersed in an aqueous dispersion medium, if desired, together with a polymerization initiator and a colorant, so as to become particles in the dispersion medium;

(2) the thus prepared monomer particles are classified such that the particles have a proper particle size;

(3) the classified monomer particles having a proper size are polymerized; and (4) the polymerized product is subjected to a treatment such that the dispersant is removed from the product, and then filtered, washed with water and dried to prepare a mother toner.

The capsule method is as follows:

(1) one or more binder resins are kneaded by a kneader, if desired, together with a magnetic powder, to prepare a melting toner core material;

(2) the toner core material is added into water and then strongly stirred to prepare particulate toner core material;

(3) the particulate toner core material is added into a solution of a shell material, and then a poor solvent is added to the mixture to cover the core material with the shell material, i.e., to prepare capsules; and (4) the thus prepared capsules are filtered and then dried to prepare a mother toner.

The mother toner particles, the particulate fluorine-containing material and the particulate inorganic material are mixed by, for example, a high speed mixer such as a Henshel mixer (manufactured by Mitsui Miike Machinery Co., Ltd.), Mechanofusion System (manufatured by Hosokawa Micron Corp.), Mechanomill (manufactured by Okada Seiko Co., Ltd.), and the like.

When, for example, a Henshel mixer is used, the fluorine-containing material and the inorganic material are effectively adhered to the mother toner particles by properly controlling the shape, revolution speed, mixing time, etc. of the rotating blade. In detailed description, the rotating speed of the tip edge of the rotating blade is preferably from 15 to 35 m/sec. When the rotating speed of the tip edge of the rotating blade is less than 15 m/sec, the mother toner particles, fluorine-containing material and inorganic material cannot be sufficiently mixed, and therefore free fluorine-containing material and inorganic material tend to adhere to the latent image bearing member, developing roller and carrier. Therefore the filming problem tends to occur, and the image qualities of the resultant toner images deteriorate (i.e., background fouling and the like occur), which is caused by decrease of charge quantity of the toner.

In contrast, when the rotation speed is greater than 35 m/sec, the fluorine-containing material and the inorganic material tend to be buried in the mother toner particles, resulting in formation of toner aggregates, and thereby a toner having good fluidity cannot be obtained. In addition, a problem which occurs is that the mother toner particles are melted by the heat generated in the mixing process particularly when color toners including a resin having relatively low softening point are manufactured.

In addition, if there are many aggregates in the resultant toner, there are large particles of the fluorine-containing material and inorganic material in the resultant toner, or there are many free particles of the fluorine-containing material and inorganic material, the toner is preferably sieved using a screen having an opening not greater than a few hundred micrometer, or is re-classified, to remove the aggregates or the large particles from the toner.

Next, the image forming method will be explained referring to FIG. 1.

FIG. 1 is a schematic view illustrating the cross section of an embodiment of the electrophotographic image forming apparatus (hereinafter referred to as a copier) for use in the image forming method of the present invention.

A copier 201 mainly includes a scanner 101 serving as an image reading device, and a printer 112 serving as an image outputting device. The scanner 101 is provided for optically reading the image of an original document, and includes a contact glass 209, a lamp 210 irradiating light, a reflection mirror 211, a focusing lens 212, a CCD image sensor 213, etc. A halogen lamp is generally used as the lamp 210.

The image of an original document is read as follows. The lamp 210 irradiates the original document, which is set on the contact glass 209, with light. The light reflected from the original document is lead to the focusing lens 212 by the reflection mirror 211 or the like. The reflection light is focused on the CCD image sensor 213 by the focusing lens 212. The CCD image sensor 213 converts the reflection light to digital electric signals. The CCD image sensor 213 is a full color image sensor, and therefore the light signals are separated into a red (R) color, a green (G) color, and a blue (B) color, and digital electric signals corresponding each color are output. In the CCD image sensor 213, CCDs are arrayed in a direction perpendicular to the sheet on which FIG. 1 is drawn. The digital electric signals output from the CCD image sensor 213 are subjected to an image processing such as a color changing treatment by an image processing part mentioned below, to form color image data including cyan color (C) image data, magenta color (M) image data, yellow color (Y) image data and black color (BK) image data. Full color images are formed according to these color image data by the following method mentioned below using the printer 112 and color toners, Y, M, C and Bk.

In almost the center of the printer 112, a photoconductor 215 serving as a latent image bearing member is provided. The photoconductor 215 is an organic photoconductor (OPC) drum and the diameter of the drum is about 120 mm. Around the peripheral surface of the photoconductor 215, a charging device 207 uniformly charging the surface of the photoconductor 215, a BK developing unit 202, a C developing unit 203, a M developing unit 204, a Y developing unit 205, an intermediate transfer member 206, a cleaning device 214, etc. are provided. In addition, a laser optical device 208 is provided between the photoconductor 215 and the scanner 101. The laser optical device 208 scans the photoconductor 215, which is entirely charged, with a laser light beam. The laser optical device 208 includes a laser diode radiating a laser beam, and a polygon mirror deflecting the laser beam, etc.

The image forming process of the printer 112 will be explained referring to a Bk image forming process. The laser optical device 208 irradiates the photoconductor 215 with a laser beam which is based on the Bk image data to form a latent Bk image on the photoconductor 215. The latent Bk image is developed by the Bk developing unit 202 to form a Bk toner image. The Bk toner image is transferred onto the intermediate transfer member 206 (hereinafter this transferring is referred to as belt transferring). The processes of latent image forming, developing, and belt transferring are performed with respect to the four colors, i.e., C. M. Y and Bk to form four color toner images on the intermediate transfer member 206, which are overlaid. The thus overlaid four color toner images are transferred at a time onto a receiving material such as a paper sheet, which is fed from a paper feeding unit 216, by a transfer bias roller 217.

The receiving material having four color toner images thereon is fed by a feeding belt 218 to a fixing device 219. The fixing device 219 applies heat and pressure to the color toner images to melt and fix the toner images on the receiving material. The receiving material having the fixed toner images thereon is discharged onto a tray 220. The toner remaining on the photoconductor 215 is removed by the cleaning device 214 to clean the surface of the photoconductor 215. Then the photoconductor 215 is discharged by a discharger. The toner remaining on the intermediate transfer member 206 is removed by a belt cleaning device 222 to clean the surface of the intermediate transfer member 206.

A belt-shaped transfer belt as shown in FIG. 1 is especially preferable as the intermediate transfer member 206. As for the structure of the intermediate transfer member, a multilayer structure, in which at least a surface layer is formed on a substrate, is preferable. The surface layer is formed on a substrate prepared by extrusion by any one of coating methods such as dipping methods, roller coating methods, spray coating methods, casting methods and the like.

Suitable substrates for use in the intermediate transfer member include thermoplastic resins such as polyethylene, polystyrene, polyvinyl chloride, polyesters, nylons, polycarbonates, polyacrylonitrile, polyvinylidenefluoride, ethylene-tetrafluoroethylene copolymers and the like. The substrate may include one or more organic electroconductive materials such as polyethylene oxide, polypyrrole, quaternary ammonium salts, etc., and/or one or more inorganic electroconductive materials such as carbon black, zinc oxide, metal powders, etc., to decrease its resistivity.

Suitable materials for use in the surface layer include thermoplastic resins mentioned above, and thermosetting resins such as phenolic resins, urea resins, melamine resins, silicone resins, fluorine-containing resins, acrylic resins and the like. The surface layer may include one or more organic electroconductive materials such as polyethylene oxide, polypyrrole, quaternary ammonium salts, etc., and/or one or more inorganic electroconductive materials such as carbon black, zinc oxide, metal powders, etc., to decrease its resistivity.

When toner images are transferred using a roller from the latent image bearing member to the intermediate transfer member (first transfer) or from the intermediate transfer member to the receiving material (second transfer), the pressure in the first and second transfer is preferably from 0.007 to 1.5 N/cm$^2$, and from 4 to 15 N/cm$^2$, respectively, to transfer good toner images without omission.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Mother Toner

The following components were mixed by a Henshel mixer.

Polyester resin (binder resin) 100 (a polyester resin made bypolymerizing an adduct of bisphenol A with propylene oxide, terephthalic acid and a succinic acid derivative)

Quinacridone type magenta pigment (colorant) 4 (C.I. Pigment Red 122)

Zn salt of salicylic acid derivative 2 (charge controlling agent)

The mixture was melted and kneaded by a two-axis kneader heated at 130° C. The kneaded mixture was cooled, crushed by a cutter mill and then pulverized by a pulverizer using jet air. The powder was then classified using an air classifier to prepare four mother toners 1 to 4. The weight average particle diameter (Dw), number average particle diameter (Dn), and ratio Dw/Dn thereof are as follows.

| | Dw | Dn | Dw/Dn |
|---|---|---|---|
| Mother toner 1 | 10.3 μm | 6.6 μm | 1.6 |
| Mother toner 2 | 6.6 μm | 4.2 μm | 1.6 |
| Mother toner 3 | 9.8 μm | 7.3 μm | 1.3 |
| Mother toner 4 | 6.3 μm | 4.7 μm | 1.3 |

Example 1

Preparation of Toner

The following materials were mixed by a Henshel mixer and then sieved using a screen having an opening of 75 μm.

Mother toner 1 100

Polyvinylidene fluoride 1.5 (particulate fluorine-containing material, volume average particle diameter of 1.2 μm)

The rotating speed of the tip edge of the rotating blade of the Henshel mixer was 25 m/sec. Thus an electrophotographic toner of Example 1 was prepared.

Example 2

The procedure for preparation of the toner in Example 1 was repeated to prepare a toner of Example 2 except that polyvinylidene fluoride was replaced with 1.5 parts by weight of polytetrafluoroethylene (volume average particle diameter of 1.2 μm).

Example 3

The procedure for preparation of the toner in Example 1 was repeated to prepare a toner of Example 3 except that polyvinylidene fluoride was replaced with 1.5 parts by weight of cerium oxide (volume average particle diameter of 1.2 μm, fluorine content of 1.0% by weight).

Example 4

The procedure for preparation of the toner in Example 1 was repeated to prepare a toner of Example 4 except that polyvinylidene fluoride was replaced with 1.5 parts by weight of cerium oxide (volume average particle diameter of 1.2 μm) which had been treated with trifluoropropyltrimethoxy silane.

Example 5

The procedure for preparation of the toner in Example 1 was repeated to prepare a toner of Example 5 except that polyvinylidene fluoride was replaced with 1.5 parts by weight of polytetrafluoroethylene (volume average particle diameter of 0.3 μm)

Example 6

The procedure for preparation of the toner in Example 1 was repeated to prepare a toner of Example 6 except that polyvinylidene fluoride was replaced with 0.6 parts by weight of polytetrafluoroethylene (volume average particle diameter of 1.2 μm).

Example 7

The procedure for preparation of the toner in Example 2 was repeated to prepare a toner of Example 7 except that 0.6 parts by weight of a silica, which had an average particle diameter of 0.016 μm and which had been treated with a silicone oil, were externally added as a particulate inorganic material to the mother toner and the fluorine-containing material.

Example 8

The procedure for preparation of the toner in Example 2 was repeated to prepare a toner of Example 8 except that 0.6 parts by weight of a titania, which had an average particle diameter of 0.021 μm and which had been treated with isobutyltrimethoxy silane, were externally added as a particulate inorganic material to the mother toner and the fluorine-containing material.

Example 9

The procedure for preparation of the toner in Example 2 was repeated to prepare a toner of Example 9 except that 0.6 parts by weight of an alumina, which had an average particle diameter of 0.013 μm and which had been treated with isobutyltrimethoxy silane, were externally added as a particulate inorganic material to the mother toner and the fluorine-containing material.

Example 10

The procedure for preparation of the toner in Example 2 was repeated to prepare a toner of Example 10 except that 0.6 parts by weight of a silica, which had an average particle diameter of 0.016 μm and which had been treated with a silicone oil, and 0.3 parts by weight of a titania, which had an average particle diameter of 0.021 μm and which had been treated with isobutyltrimethoxy silane, were externally added as particulate inorganic materials to the mother toner and the fluorine-containing material.

Example 11

The procedure for preparation of the toner in Example 2 was repeated to prepare a toner of Example 11 except that 0.3 parts by weight of a silica, which had an average particle diameter of 0.016 μm and which had been treated with a silicone oil, and 0.6 parts by weight of a titania, which had an average particle diameter of 0.021 μm and which had been treated with isobutyltrimethoxy silane, were externally added as particulate inorganic materials to the mother toner and the fluorine-containing material.

Example 12

The procedure for preparation of the toner in Example 2 was repeated to prepare a toner of Example 12 except that the mother toner 1 was replaced with the mother toner 2, i.e., the weight average particle diameter Dw of the mother toner and the number average particle diameter Dn thereof were changed to 6.6 μm and 4.2 μm, respectively. The ratio Dw/Dn (1.6) was not changed.

Example 13

The procedure for preparation of the toner in Example 2 was repeated to prepare a toner of Example 13 except that the mother toner 1 was replaced with the mother toner 3, i.e., the weight average particle diameter Dw of the mother toner and the number average particle diameter Dn thereof, and the ratio Dw/Dn were changed to 9.8 μm, 7.3 μm, and 1.3, respectively.

Example 14

The procedure for preparation of the toner in Example 11 was repeated except that:

(1) the mother toner 1 was replaced with the mother toner 4, i.e., the weight average particle diameter Dw of the mother toner, and the number average particle diameter Dn thereof, and the ratio Dw/Dn were changed to 6.3 μm, 4.7 μm, and 1.3, respectively; and (2) the addition amount and volume average particle diameter of polytetrafluoroethylene were changed to 0.6 parts and 0.3 μm, respectively.

Comparative Example 1

The procedure for preparation of the toner in Example 14 was repeated to prepare a toner of Comparative Example 1 except that polytetrafluoroethylene was not added to the mother toner.

Comparative Example 2

The procedure for preparation of the toner in Example 14 was repeated to prepare a toner of Comparative Example 2 except that polytetrafluoroethylene was not added to the mother toner, and 0.3 parts by weight of zinc stearate (volume average particle diameter of 0.05 μm) were externally added to the mother toner.

Preparation of Carrier

The following components were mixed to prepare a coating liquid.

Silicone resin solution 500 g (SR-2411 manufactured by Dow Corning Toray Silicone Co., Ltd., solid content of 20%)

Toluene 1450 g

Five (5) kilograms of a Cu-Zn ferrite having a particle diameter of 45 μm were contained in a fluidized bed type coating apparatus. The coating liquid was sprayed to the fluidized ferrite under a condition of 80° C. in temperature. The coated ferrite was calcined at 270° C. for 2 hours.

Thus, a silicone coated carrier was prepared.

Preparation of Developer

Five (5) parts of each toner prepared in Examples 1 to 14 and Comparative Examples 1 to 2 were mixed with the carrier for 10 minutes using a TURBULA shaker mixer to prepare a developer.

Four hundred (400) grams of the thus prepared developer were set in a full color copier (PRETER550 manufactured by Ricoh Co., Ltd.) having a structure as shown in FIG. 1, and 30,000 copies were continuously reproduced under conditions of normal temperature and normal humidity.

A coating device, which had been provided in the copier for coating zinc stearate on the intermediate transfer member, was removed therefrom. The intermediate transfer member was prepared by spray-coating polyvinylidene fluoride on a seamless belt which had been prepared by extruding a melted and kneaded ethylene-tetrafluoroethylene copolymer including carbon black was added.

The contact pressure in the first transfer process (toner image transfer from the latent image bearing member to the intermediate transfer member) was 0.03 $N/cm^2$, and the contact pressure in the second transfer process (toner image transfer from the intermediate transfer member to the receiving material) was 7 $N/cm^2$.

Comparative Example 3

The procedures for preparation of the developer and image formation in Comparative Example 1 was repeated except that the coating device coating zinc stearate on the intermediate transfer member was not removed from the copier.

Evaluation Methods

1. Image density

The image density of a magenta solid image, which was produced before and after the 30,000 copies running test, was measured by a Macbeth reflection densitometer RD918. The difference between the initial image density and the final image density was also calculated. The larger the image density difference, the poorer durability the toner has.

2. Fluidity of developer

Fluidity of the developer before and after the running test was evaluated by the following method:

(1) Fifty (50.0) grams of a developer were put into an orifice of an instrument capable of measuring bulk density, which had a diameter of 3.00 mm, while the bottom exit of the orifice was closed; and (2) The bottom exit was opened and the time was measured with a stopwatch from the opening of the bottom exit to the time in which all the developer was discharged from the orifice.

The fluidity of the developer, which had been subjected to the running test, was measured after the toner content of the developer was adjusted so as to be 5%, which was the same as the initial content.

The fluidity was classified into the following four grades:

◎: very good

○: good

Δ: acceptable

×: not acceptable

3. Toner filming on intermediate transfer member

The intermediate transfer member was observed to determine whether toner filming occurred on the intermediate transfer member. The filming was checked after every 1000 copies. The toner filming was also classified into the four grades as mentioned above in paragraph 2.

4. Worm-eaten images

Images of one dot magenta lines were reproduced before and after the running test. One line of the line images was observed by a microscope VH-5910, which was manufactured by Keyence Corp. and which was provided with a lens with a magnifying power of 200 (VH-200), to determine whether worm-eaten problems occurred. The worm-eaten images were also classified into the four grades as mentioned above.

5. White spots

Ten magenta color solid images of A3 size were continuously produced before and after the running test. The solid images were visually observed to determine whether white spots were observed therein. The white spots of the solid images were also classified into the four grades as mentioned above.

6. Background fouling

An image was formed before and after the running test. The image was visually observed to determine whether background fouling was observed in the background area of the image. The background fouling of the image was also classified into the four grades as mentioned above.

7. Toner scattering

Toner scattering was evaluated before and after the running test by visually observing the inside of the copier to determine whether the toner scattered therein. The toner scattering qualities of each toner was also classified into the four grades as mentioned above.

The results are shown in Tables 1 and 2.

TABLE 1

| | Image density | | | Fluidity | | | Filming | |
|---|---|---|---|---|---|---|---|---|
| | | | | | After | | | |
| | Initial | After running test | Difference | Initial (sec) | running test (sec) | Grade | After running test | Remarks |
| Ex. 1 | 1.39 | 1.26 | −0.13 | 42.75 | 53.66 | Δ | ○ | |
| Ex. 2 | 1.38 | 1.23 | −0.14 | 42.68 | 59.50 | Δ | ○ | |
| Ex. 3 | 1.37 | 1.26 | −0.11 | 40.01 | 51.11 | Δ | ○ | |
| Ex. 4 | 1.39 | 1.27 | −0.12 | 41.20 | 50.69 | Δ | ○ | |
| Ex. 5 | 1.36 | 1.21 | −0.15 | 39.44 | 40.75 | ○ | ◎ | |
| Ex. 6 | 1.37 | 1.31 | −0.06 | 43.88 | 51.94 | ○ | ◎ | |
| Ex. 7 | 1.36 | 1.43 | 0.07 | 34.18 | 44.25 | Δ | ◎ | |
| Ex. 8 | 1.39 | 1.41 | 0.03 | 39.85 | 53.71 | Δ | ◎ | |
| Ex. 9 | 1.40 | 1.44 | 0.04 | 34.81 | 42.96 | Δ | ◎ | |
| Ex. 10 | 1.39 | 1.46 | 0.07 | 34.95 | 35.98 | ○ | ◎ | |
| Ex. 11 | 1.35 | 1.35 | 0.00 | 30.93 | 34.43 | ○ | ◎ | |
| Ex. 12 | 1.36 | 1.36 | 0.00 | 42.24 | 53.16 | Δ | ○ | |
| Ex. 13 | 1.39 | 1.38 | −0.02 | 39.19 | 49.16 | Δ | ○ | |
| Ex. 14 | 1.36 | 1.37 | 0.01 | 34.35 | 31.29 | ◎ | ◎ | |
| Comp. Ex. 1 | 1.36 | 1.13 | −0.23 | 31.72 | 43.43 | Δ | x | Δ At 2000th copy x At 5000th copy |
| Comp. Ex. 2 | 1.38 | 1.08 | −0.29 | 39.87 | 58.30 | x | x | Δ At 5000th copy x At 5000th copy |
| Comp. Ex. 3 | 1.37 | 1.19 | −0.18 | 30.83 | 38.22 | Δ | Δ | ○ At 10000th copy Δ At 18000th copy |

TABLE 2

| | Worm-eaten images | | White spots | | Background fouling | | Toner scattering | |
|---|---|---|---|---|---|---|---|---|
| | Initial | After running test | Initial | After running test | Initial | After running test | Initial | After running test |
| Ex. 1 | ◎ | ○ | ◎ | ◎ | ◎ | ○ | ◎ | ○ |
| Ex. 2 | ◎ | ○ | ◎ | ◎ | ◎ | ○ | ◎ | ○ |
| Ex. 3 | ◎ | ○ | ◎ | ◎ | ◎ | ○ | ◎ | ○ |
| Ex. 4 | ◎ | ○ | ◎ | ◎ | ◎ | ○ | ◎ | ○ |
| Ex. 5 | ◎ | ◎ | ◎ | ◎ | ◎ | ○ | ◎ | ○ |
| Ex. 6 | ◎ | ◎ | ◎ | ○ | ◎ | ○ | ◎ | ○ |
| Ex. 7 | ◎ | ○ | ◎ | ◎ | ◎ | ○ | ◎ | ◎ |
| Ex. 8 | ◎ | ○ | ◎ | ◎ | ◎ | ◎ | ◎ | ◎ |
| Ex. 9 | ◎ | ○ | ◎ | ◎ | ◎ | ◎ | ◎ | ○ |
| Ex. 10 | ◎ | ○ | ◎ | ◎ | ◎ | ○ | ◎ | ○ |
| Ex. 11 | ◎ | ○ | ◎ | ◎ | ◎ | ◎ | ◎ | ○ |
| Ex. 12 | ◎ | ○ | ◎ | ◎ | ◎ | ○ | ◎ | ◎ |
| Ex. 13 | ◎ | ◎ | ◎ | ◎ | ◎ | ○ | ◎ | ○ |
| Ex. 14 | ◎ | ◎ | ◎ | ◎ | ◎ | ◎ | ◎ | ◎ |
| Comp. Ex. 1 | ○ | x | ○ | x | ◎ | x | ◎ | x |
| Comp. Ex. 2 | ○ | x | ○ | x | ◎ | x | ◎ | x |
| Comp. Ex. 3 | ○ | x | ○ | x | ◎ | Δ | ◎ | Δ |

As can be understood from Tables 1 and 2, the toners of the present invention hardly cause toner filming on the intermediate transfer member and can produce images having good image qualities even when used for a long time.

This document claims priority and contains subject matter related to Japanese Patent Application No. 11-022959, filed on Jan. 29, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic toner, which is useful in an image forming method in which a toner image, which is formed on a latent bearing member, is transferred onto an intermediate transfer member and then the transferred toner image is transferred onto a receiving material, comprising:

toner particles comprising a binder resin and a colorant and having a ratio (Dw/Dn) of a weight average diameter (Dw) to number average particle diameter (Dn) ranging from 1.0 to 1.5; and a particulate fluorine-containing material.

2. The electrophotographic toner according to claim 1, wherein the particulate fluorine-containing material comprises a particulate fluorine-containing resin.

3. The electrophotographic toner according to claim 2, wherein the particulate fluorine-containing resin comprises polytetrafluoroethylene.

4. The electrophotographic toner according to claim 1, wherein the particulate fluorine-containing material comprises a particulate fluorine-containing inorganic material.

5. The electrophotographic toner according to claim 1, wherein the particulate fluorine-containing material is present in the toner in an amount ranging from 0.01 parts to 1.1 parts by weight per 100 parts by weight of the toner particles.

6. The electrophotographic toner according to claim 1, wherein the particles of particulate fluorine-containing material have a volume average particle diameter ranging from 0.05 $\mu$m to 1.0 $\mu$m.

7. The electrophotographic toner according to claim 1, wherein the toner further comprises a particulate inorganic material in an amount ranging from 0.3 parts to 1.6 parts by weight per 100 parts by weight of the toner particles.

8. The electrophotographic toner according to claim 7, wherein the particulate inorganic material comprises a silica which is subjected to a surface treatment, and a titania which is subjected to a surface treatment.

9. The electrophotographic toner according to claim 8, wherein the surface-treated titania is present in the toner in an amount greater than that of the surface-treated silica.

10. The electrophotographic toner according to claim 1, wherein the toner has a weight average particle diameter ranging from 4 to 9 $\mu$m.

11. The electrophotographic toner according to claim 1, wherein the particulate fluorine-containing material has a spherical degree of not less that 0.95.

12. A method of forming an electrophotographic image, comprising:

providing a toner comprising toner particles having a ratio (Dw/Dn) of a weight average diameter (Dw) to number average particle diameter (Dn) ranging from 1.0 to 1.5 and comprising a binder resin, a colorant, and a particulate fluorine-containing material;

forming a latent image on a latent image bearing member;

developing the latent image with the toner to form a toner image thereon;

firstly transferring the toner image onto an intermediate transfer member;

secondly transferring the toner image from the intermediate transfer member onto a receiving material; and fixing the toner image on the receiving material.

13. The electrophotographic image forming method according to claim 12, wherein the particulate fluorine-containing material comprises a particulate fluorine-containing resin.

14. The electrophotographic image forming method according to claim 13, wherein the particulate fluorine-containing resin comprises polytetrafluoroethylene.

15. The electrophotographic image forming method according to claim 12, wherein the particulate fluorine-containing material comprises a particulate fluorine-containing inorganic material.

16. The electrophotographic image forming method according to claim 12, wherein the particulate fluorine-containing material is present in the toner in an amount ranging from 0.01 parts to 1.1 parts by weight per 100 parts by weight of the toner particles.

17. The electrophotographic image forming method according to claim 12, wherein the particulate fluorine-containing material has a volume average particle diameter ranging from 0.05 $\mu$m to 1.0 $\mu$m.

18. The electrophotographic image forming method according to claim 12, wherein the toner further comprises a particulate inorganic material in an amount ranging from 0.3 parts to 1.6 parts by weight per 100 parts by weight of the toner particles.

19. The electrophotographic image forming method according to claim 18, wherein the particulate inorganic material comprises a silica which is subjected to a surface treatment, and a titania which is subjected to a surface treatment.

20. The electrophotographic image forming method according to claim 19, wherein the surface-treated titania is present in the toner in an amount greater than that of the surface-treated silica.

21. The electrophotographic image forming method according to claim 12, wherein the toner has a weight average particle diameter ranging from 4 to 9 $\mu$m.

* * * * *

UNITED STATES PATENT AND TRADEMARK OFFICE

CERTIFICATE OF CORRECTION

PATENT NO. : 6,303,258 B1
DATED : October 16, 2001
INVENTOR(S) : Kohki Katoh et al.

It is certified that error appears in the above-identified patent and that said Letters Patent is hereby corrected as shown below:

Column 1,
Line 65, "transfermember," should read -- trasnfer member, --.

Column 4,
Line 51, "an charge controlling" should read -- a charge controlling --.

Column 8,
Line 4, "the tone images" should read -- the toner images --;
Line 37, "into the another" should read -- into another --.

Column 18,
Table 1,

"

TABLE 1

| | Image density | | | Fluidity | | | Filming | |
|---|---|---|---|---|---|---|---|---|
| | Initial | After running test | Difference | Initial (sec) | After running test (sec) | Grade | After running test | Remarks |
| Ex. 1 | 1.39 | 1.26 | -0.13 | 42.75 | 53.66 | Δ | ○ | |
| Ex. 2 | 1.38 | 1.23 | -0.14 | 42.68 | 59.50 | Δ | ○ | |
| Ex. 3 | 1.37 | 1.26 | -0.11 | 40.01 | 51.11 | Δ | ○ | |
| Ex. 4 | 1.39 | 1.27 | -0.12 | 41.20 | 50.69 | Δ | ○ | |
| Ex. 5 | 1.36 | 1.21 | -0.15 | 39.44 | 40.75 | ○ | ◎ | |
| Ex. 6 | 1.37 | 1.31 | -0.06 | 43.88 | 51.94 | ○ | ◎ | |
| Ex. 7 | 1.36 | 1.43 | 0.07 | 34.18 | 44.25 | Δ | ◎ | |
| Ex. 8 | 1.39 | 1.41 | 0.03 | 39.85 | 53.71 | Δ | ◎ | |
| Ex. 9 | 1.40 | 1.44 | 0.04 | 34.81 | 42.96 | Δ | ◎ | |
| Ex. 10 | 1.39 | 1.46 | 0.07 | 34.95 | 35.98 | ○ | ◎ | |
| Ex. 11 | 1.35 | 1.35 | 0.00 | 30.93 | 34.43 | ○ | ◎ | |
| Ex. 12 | 1.36 | 1.36 | 0.00 | 42.24 | 53.16 | Δ | ○ | |
| Ex. 13 | 1.39 | 1.38 | -0.02 | 39.19 | 49.16 | Δ | ○ | |
| Ex. 14 | 1.36 | 1.37 | 0.01 | 34.35 | 31.29 | ◎ | ◎ | |
| Comp. Ex. 1 | 1.36 | 1.13 | -0.23 | 31.72 | 43.43 | Δ | x | Δ At 2000th copy x At 5000th copy |
| Comp. Ex. 2 | 1.38 | 1.08 | -0.29 | 39.87 | 58.30 | x | x | Δ At 5000th copy x At 5000th copy |
| Comp. Ex. 3 | 1.37 | 1.19 | -0.18 | 30.83 | 38.22 | Δ | Δ | ○ At 10000th copy Δ At 18000th copy |

"

UNITED STATES PATENT AND TRADEMARK OFFICE

CERTIFICATE OF CORRECTION

PATENT NO. : 6,303,258 B1
DATED : October 16, 2001
INVENTOR(S) : Kohki Katoh et al.

It is certified that error appears in the above-identified patent and that said Letters Patent is hereby corrected as shown below:

Column 18,
Table 1, should read "

TABLE 1

| | Image density | | | Fluidity | | | Filming | |
|---|---|---|---|---|---|---|---|---|
| | Initial | After running test | Difference | Initial (sec) | After running test (sec) | Grade | After running test | Remarks |
| Ex. 1 | 1.39 | 1.26 | −0.13 | 42.75 | 53.66 | Δ | ○ | |
| Ex. 2 | 1.38 | 1.23 | −0.14 | 42.68 | 59.50 | Δ | ○ | |
| Ex. 3 | 1.37 | 1.26 | −0.11 | 40.01 | 51.11 | Δ | ○ | |
| Ex. 4 | 1.39 | 1.27 | −0.12 | 41.20 | 50.69 | Δ | ○ | |
| Ex. 5 | 1.36 | 1.21 | −0.15 | 39.44 | 40.75 | ○ | ◎ | |
| Ex. 6 | 1.37 | 1.31 | −0.06 | 43.88 | 51.94 | ○ | ◎ | |
| Ex. 7 | 1.36 | 1.43 | 0.07 | 34.18 | 44.25 | Δ | ◎ | |
| Ex. 8 | 1.39 | 1.41 | 0.03 | 39.85 | 53.71 | Δ | ◎ | |
| Ex. 9 | 1.40 | 1.44 | 0.04 | 34.81 | 42.96 | Δ | ◎ | |
| Ex. 10 | 1.39 | 1.46 | 0.07 | 34.95 | 35.98 | ○ | ◎ | |
| Ex. 11 | 1.35 | 1.35 | 0.00 | 30.93 | 34.43 | ○ | ◎ | |
| Ex. 12 | 1.36 | 1.36 | 0.00 | 42.24 | 53.16 | Δ | ○ | |
| Ex. 13 | 1.39 | 1.38 | −0.02 | 39.19 | 49.16 | Δ | ○ | |
| Ex. 14 | 1.36 | 1.37 | 0.01 | 34.35 | 31.29 | ◎ | ◎ | |
| Comp. Ex. 1 | 1.36 | 1.13 | −0.23 | 31.72 | 43.43 | Δ | x | Δ At 2000th copy x At 5000th copy |
| Comp. Ex. 2 | 1.38 | 1.08 | −0.29 | 39.87 | 58.30 | x | x | Δ At 5000th copy x At 8000th copy |
| Comp. Ex. 3 | 1.37 | 1.19 | −0.18 | 30.83 | 38.22 | Δ | Δ | ○ At 10000th copy Δ At 18000th copy |

Column 19,
Table 2, "

TABLE 2

| | Worm-eaten images | | White spots | | Background fouling | | Toner scattering | |
|---|---|---|---|---|---|---|---|---|
| | Initial | After running test | Initial | After running test | Initial | After running test | Initial | After running test |
| Ex. 1 | ◎ | ○ | ◎ | ◎ | ◎ | ○ | ◎ | ○ |
| Ex. 2 | ◎ | ○ | ◎ | ◎ | ◎ | ○ | ◎ | ○ |
| Ex. 3 | ◎ | ○ | ◎ | ◎ | ◎ | ○ | ◎ | ○ |
| Ex. 4 | ◎ | ○ | ◎ | ◎ | ◎ | ○ | ◎ | ○ |
| Ex. 5 | ◎ | ◎ | ◎ | ◎ | ◎ | ○ | ◎ | ○ |
| Ex. 6 | ◎ | ◎ | ◎ | ○ | ◎ | ○ | ◎ | ○ |
| Ex. 7 | ◎ | ○ | ◎ | ◎ | ◎ | ○ | ◎ | ◎ |
| Ex. 8 | ◎ | ○ | ◎ | ◎ | ◎ | ◎ | ◎ | ◎ |
| Ex. 9 | ◎ | ○ | ◎ | ◎ | ◎ | ◎ | ◎ | ○ |
| Ex. 10 | ◎ | ○ | ◎ | ◎ | ◎ | ○ | ◎ | ○ |
| Ex. 11 | ◎ | ○ | ◎ | ◎ | ◎ | ◎ | ◎ | ○ |
| Ex. 12 | ◎ | ○ | ◎ | ◎ | ◎ | ○ | ◎ | ◎ |
| Ex. 13 | ◎ | ◎ | ◎ | ◎ | ◎ | ○ | ◎ | ○ |
| Ex. 14 | ◎ | ◎ | ◎ | ◎ | ◎ | ◎ | ◎ | ◎ |
| Comp. Ex. 1 | ○ | x | ○ | x | ◎ | x | ◎ | x |
| Comp. Ex. 2 | ○ | x | ○ | x | ◎ | x | ◎ | x |
| Comp. Ex. 3 | ○ | x | ○ | x | ◎ | Δ | ◎ | Δ |

UNITED STATES PATENT AND TRADEMARK OFFICE

CERTIFICATE OF CORRECTION

PATENT NO. : 6,303,258 B1
DATED : October 16, 2001
INVENTOR(S) : Kohki Katoh et al.

It is certified that error appears in the above-identified patent and that said Letters Patent is hereby corrected as shown below:

Column 19,
Table 2 should read --

TABLE 2

| | Worm-eaten images | | White spots | | Background fouling | | Toner scattering | |
|---|---|---|---|---|---|---|---|---|
| | Initial | After running test | Initial | After running test | Initial | After running test | Initial | After running test |
| Ex. 1 | ◎ | ○ | ◎ | ◎ | ◎ | ○ | ◎ | ○ |
| Ex. 2 | ◎ | ○ | ◎ | ◎ | ◎ | ○ | ◎ | ○ |
| Ex. 3 | ◎ | ○ | ◎ | ◎ | ◎ | ○ | ◎ | ○ |
| Ex. 4 | ◎ | ○ | ◎ | ◎ | ◎ | ○ | ◎ | ○ |
| Ex. 5 | ◎ | ◎ | ◎ | ◎ | ◎ | ○ | ◎ | ○ |
| Ex. 6 | ◎ | ◎ | ◎ | ○ | ◎ | ○ | ◎ | ○ |
| Ex. 7 | ◎ | ○ | ◎ | ◎ | ◎ | ○ | ◎ | ◎ |
| Ex. 8 | ◎ | ○ | ◎ | ◎ | ◎ | ◎ | ◎ | ◎ |
| Ex. 9 | ◎ | ○ | ◎ | ◎ | ◎ | ◎ | ◎ | ○ |
| Ex. 10 | ◎ | ○ | ◎ | ◎ | ◎ | ○ | ◎ | ◎ |
| Ex. 11 | ◎ | ○ | ◎ | ◎ | ◎ | ◎ | ◎ | ◎ |
| Ex. 12 | ◎ | ○ | ◎ | ◎ | ◎ | ○ | ◎ | ◎ |
| Ex. 13 | ◎ | ◎ | ◎ | ◎ | ◎ | ○ | ◎ | ○ |
| Ex. 14 | ◎ | ◎ | ◎ | ◎ | ◎ | ◎ | ◎ | ◎ |
| Comp. Ex. 1 | ○ | x | ○ | x | ◎ | x | ◎ | x |
| Comp. Ex. 2 | ○ | x | ○ | x | ◎ | x | ◎ | x |
| Comp. Ex. 3 | ○ | x | ○ | x | ◎ | Δ | ◎ | Δ |

--.

Column 20,
Line 47, "less that 0.95." should read -- less than 0.95. --.

Signed and Sealed this

Eighteenth Day of June, 2002

*Attest:*

*Attesting Officer*

JAMES E. ROGAN
*Director of the United States Patent and Trademark Office*